US012408776B2

(12) United States Patent
Brody et al.

(10) Patent No.: US 12,408,776 B2
(45) Date of Patent: Sep. 9, 2025

(54) FOLDABLE BED

(71) Applicant: SLEEP RIGHT PRODUCTS LLC, North Brunswick, NJ (US)

(72) Inventors: Lawrence C. Brody, Monroe Township, NJ (US); Preston Baker, Plainsboro, NJ (US); Richard Keschinger, Houston, TX (US)

(73) Assignee: SLEEP RIGHT PRODUCTS LLC, North Brunswick, NJ (US)

( * ) Notice: Subject to any disclaimer, the term of this patent is extended or adjusted under 35 U.S.C. 154(b) by 202 days.

(21) Appl. No.: 17/992,786

(22) Filed: Nov. 22, 2022

(65) Prior Publication Data

US 2023/0157465 A1 May 25, 2023

Related U.S. Application Data

(60) Provisional application No. 63/282,465, filed on Nov. 23, 2021.

(51) Int. Cl.
*A47G 9/08* (2006.01)
*A47G 9/06* (2006.01)

(52) U.S. Cl.
CPC ..... *A47G 9/08* (2013.01); *A47G 9/062* (2013.01); *A47G 9/086* (2013.01); *A47G 9/06* (2013.01)

(58) Field of Classification Search
CPC ..... A47G 9/08; A47G 9/086; A47G 9/062; A47G 9/06; A47G 27/0212;
(Continued)

(56) References Cited

U.S. PATENT DOCUMENTS 1,356,593 A * 10/1920 Bettiker ..... 297/219.1
3,323,151 A * 6/1967 Lerman ..... A47C 7/021 297/382

(Continued)

FOREIGN PATENT DOCUMENTS

EP 695527 A1 * 2/1996 ..... A47C 27/086
WO WO-02098263 A1 * 12/2002 ..... A47D 1/103

OTHER PUBLICATIONS

Lila Bus.Shop.DE, CampSleep driver's cabin extra bed cot small VW Bus, Scudo, Expert, Vito, Trafic, Vivaro, NV 200 <https://www.lila-bus-shop.de/Kinderbetten-WoMo/VaSleep-Kiderbett-Fahrerhaus-klein.html> (Dec. 9, 2020). (2 pages total).

(Continued)

*Primary Examiner* — Robert G Santos
(74) *Attorney, Agent, or Firm* — John Maldjian, Esq.; Stevens & Lee PC

(57) ABSTRACT

A foldable bed includes a first outer panel defining a length and a width, a middle panel hingedly coupled to the first outer panel along an inner edge of the first outer panel, the middle panel defining a length and a width, the middle panel defining a cut-out having a length and a width, and a second outer panel hingedly coupled to the middle panel opposite the first outer panel and along an inner edge of the second outer panel, the second outer panel defining a length and a width. Each of the first outer panel, the middle panel, and the second outer panel includes a rigid substrate with a cushion coupled thereto, and the panels are hingedly coupled by a webbing extending across a lower surface of the foldable bed.

20 Claims, 12 Drawing Sheets

(58) Field of Classification Search
CPC ..... A47G 27/0231; A47G 27/0237; A47C 27/001; A47C 27/00; A47D 15/003; A47D 15/001
USPC ..... 5/417, 420, 657, 652, 722
See application file for complete search history.

(56) References Cited

U.S. PATENT DOCUMENTS

| | | | | | |
|---|---|---|---|---|---|
| 3,336,610 | A | | 8/1967 | Geddings | |
| 3,774,249 | A | | 11/1973 | Ybarra et al. | |
| D274,493 | S | | 7/1984 | Dyby | |
| 4,654,907 | A | * | 4/1987 | Haugaard | A45C 3/10 5/420 |
| 4,926,512 | A | | 5/1990 | Coyle | |
| 5,265,292 | A | * | 11/1993 | Underell | A47C 4/52 5/419 |
| 5,615,927 | A | * | 4/1997 | Kassai | A47D 1/00 297/452.36 |
| 5,669,089 | A | * | 9/1997 | Dees | B25H 5/00 5/722 |
| 5,950,260 | A | * | 9/1999 | Dees | B25H 5/00 5/419 |
| D430,627 | S | | 9/2000 | Bergman | |
| 6,272,704 | B1 | * | 8/2001 | Cutler | A47D 15/003 5/721 |
| 6,618,883 | B2 | * | 9/2003 | Angland | A47C 17/04 5/659 |
| 8,510,878 | B2 | | 8/2013 | Wang | |
| 8,887,327 | B2 | | 11/2014 | Davis, Jr. | |
| 9,161,641 | B2 | | 10/2015 | Wentland | |
| D770,201 | S | | 11/2016 | Dieckhaus | |
| D787,403 | S | | 5/2017 | Simonsen | |
| D877,302 | S | | 3/2020 | Hyde | |
| 10,655,324 | B2 | * | 5/2020 | Hettler | E04C 2/205 |
| 10,913,385 | B2 | | 2/2021 | Langhoff | |
| 11,583,723 | B2 | * | 2/2023 | Essex | A63B 21/4037 |
| D1,019,207 | S | * | 3/2024 | Brody | D6/605 |
| 2003/0140416 | A1 | | 7/2003 | Olenick | |
| 2003/0140423 | A1 | * | 7/2003 | Angland | A47C 17/04 5/659 |
| 2004/0177446 | A1 | * | 9/2004 | Robb | A47D 15/003 5/655 |
| 2013/0180046 | A1 | * | 7/2013 | Davis, Jr. | A61G 7/1026 5/81.1 HS |
| 2019/0145097 | A1 | * | 5/2019 | Hettler | E04C 2/284 52/309.4 |
| 2020/0282257 | A1 | * | 9/2020 | Essex | A63B 21/4037 |
| 2023/0157465 | A1 | * | 5/2023 | Brody | A47G 9/08 5/417 |

OTHER PUBLICATIONS

Lila Bus.Shop.DE, CampSleep driver's cabin extra bed cot large for Sprinter, Ducato, Boxer, etc., <https://www.lila-bus-shop.de/Kinderbetten-WoMo/VanSleep-Kinderbett-gross.html> (Dec. 9, 2020) (2 pages total).

Ebay, Easy Camper Germany Cot suitable for VW T5/T6, https://www.ebay.de/itm/Easy-Camper-Germany-Kinderbett-VW-T5-T6/152312694153? (Dec. 9, 2020). 5 pgs.

Kowalski, Jan, "Minivan Camping" Retrieved from: https://www.pinterest.com/pin/721420434041727849/ Retrieved on Dec. 9, 2020 (1 page total).

VanSleep driver's cabin extra bed cot large for Sprinter, Ducato, Boxer, Retreived from: https://www.pinterest.com/pin/321374123404802135/ (Retrieved on: Dec. 9, 2020) (2 pages total).

Presto Day Bed, posted 2022 [online], [retrieved Aug. 8, 2023]. Retrieved from internet, https://www.prestodaybed.com/gallery/ (Year: 2022) (3 pages total).

* cited by examiner

FOLDABLE BED

RELATED APPLICATIONS

This application claims priority to U.S. Provisional Patent Application Ser. No. 63/282,465, filed on Nov. 23, 2021, the entire disclosure of which is hereby expressly incorporated by reference.

BACKGROUND OF THE INVENTION

There exists a tremendous need for drivers of day cab tractors and other types of work trucks to have a way to rest and relax during their shifts. Too often, drivers are left slumped over the steering wheel, leaning against the window or in any variation of uncomfortable positions while attempting to rest and recharge. While it may seem like a person is able to drift off to sleep in some positions, it is very frequently poor, low-quality sleep that may not recharge a driver's energy levels any more than those levels would have been without sleep.

Truck drivers, in particular, are not only required to operate on a minimum amount of sleep for safety purposes, but carry the extra burden of operating some of the largest vehicles on the road and bearing the responsibility of their own safety as well as all the vehicles, fellow drivers, and infrastructure around them. Drivers may also be out on the road at all hours of the day, and may not have access to temporary resting facilities, such as hotels. Thus, sleeping in their trucks may not only be the most optimal location to rest, but may be the only option available. In order to achieve quality rest within the confines of the truck, a bed must be properly sized with appropriate dimensions to comfortably fit a person's body, while still fitting within the truck for proper placement and positioning.

Another issue that arises from use of a sleeping apparatus while out on the road is storage of the object. Storing the apparatus anywhere aside from the cabin of the day cab may not always be an option. Therefore, the apparatus may need to fit within the cab of the vehicle in order to be transported around with the driver. Developments in technology addressing each of the issues described above are therefore desirable.

SUMMARY OF THE INVENTION

The apparatus described in the present disclosure is a folding bed that allows a person, e.g., the driver of the vehicle, to rest and relax while the vehicle is safely parked to recharge before setting out on the road again. The apparatus is sized to specifically fit the dimensions of a cabin of a truck, laid across the driver's and passenger's seats, while having folding capabilities for fitting within the driver's cabin for easy storage and access.

In one aspect of the disclosure, a foldable bed may include a first outer panel defining a length and a width; a middle panel hingedly coupled to the first outer panel along an inner edge of the first outer panel, the middle panel defining a length and a width and defining a cut-out having a length and a width; and a second outer panel hingedly coupled to the middle panel opposite the first outer panel and along an inner edge of the second outer panel, the second outer panel defining a length and a width. Each of the first outer panel, the middle panel, and the second outer panel may include a rigid block with a cushion coupled thereto, and the panels are hingedly coupled by a webbing extending across a lower surface of the foldable bed. The middle panel may be sized and shaped to contact and rest on a driver's seat and a front passenger's seat of a vehicle and span a gap between the driver's seat and the front passenger's seat.

A length of the bed may be defined by the sum of the length of the first outer panel, the length of the middle panel, and the length of the second outer panel, the length of the bed measuring between about 58 inches and about 64 inches. The width of the first outer panel may be equal to the width of the middle panel, which may be equal to the width of the second outer panel, and the width of each panel may measure between about 20 inches and about 23 inches. The length of the first outer panel and the length of the second outer panel may each measure between about 14 inches and about 15.5 inches. The length of the middle panel may measure between about 30 inches and about 33 inches. The length of the cut-out may measure between about 11 inches and about 14 inches. The width of the cut-out may measure between about 4 inches and about 6 inches.

The first outer panel may be configured to fold relative to the middle panel about a hinge located between the inner edge of the first outer panel and a first edge of the middle panel to transition from a flat position to a folded position, and wherein the first outer panel includes an adhesive on a lower surface of the first outer panel configured to contact a lower surface of the middle panel to hold the first outer panel in the folded position. The second outer panel may be configured to fold relative to the middle panel about a hinge located between the inner edge of the second outer panel and a second edge of the middle panel to transition from a flat position to a folded position, and wherein the second outer panel includes an adhesive on a lower surface of the second outer panel configured to contact the lower surface of the middle panel to hold the second outer panel in the folded position. The middle panel may extend along a first plane, and when the first outer panel and the second outer panel are in the folded positions, the first and second outer panels extend along a second plane parallel to the first plane.

The foldable bed may further include an upper panel extending from an inner edge to an outer edge, the inner edge coupled to the first outer pan. The first outer panel may extend along a first plane, and the upper panel extends along a second plane oblique to the first plane. The upper panel may include at least a first support rod extending between the first plane and the second plane to hold the upper panel in an upright position. The upper panel may include an adhesive material along a portion of the inner edge contacting the first outer panel to hold the upper panel in place relative to the first outer panel. The upper panel may have a length extending between the inner edge and the outer edge, the length may measure between about 18 inches and about 21 inches. The upper panel may be configured to transition from an upright position to a flat position, wherein in the flat position, the upper panel extends along a third plane parallel to the first plane. When the upper panel is in the flat position, the upper panel may be adjacent the first outer panel, and the first outer panel may be configured to fold along a hinge between the inner edge of the first outer panel and an adjacent edge of the middle panel. The upper panel may be configured to be decoupled from the first outer panel. At least a portion of the upper panel may define a curvature.

According to another aspect of the disclosure, a kit may include a foldable bed and an upper panel attachment. The foldable bed may include a first outer panel extending along a first plane; a middle panel hingedly coupled to the first outer panel along an inner edge of the first outer panel, the middle panel defining a cut-out; and a second outer panel hingedly coupled to the middle panel opposite the first outer panel and along an inner edge of the second outer panel. The upper panel attachment may be configured to be detachably coupled to the first outer panel or the middle panel such that the upper panel attachment extends along a second plane oblique to the first plane.

BRIEF DESCRIPTION OF THE DRAWINGS

The foregoing features of the invention will be apparent from the following Detailed Description of the Invention, taken in connection with the accompanying drawings, in which.

DETAILED DESCRIPTION

As used herein, the terms "about," "generally," "approximately," and "substantially" are intended to mean that slight deviations from absolute are included within the scope of the term so modified.

A foldable bed as described in the present disclosure is intended to be placed in the cabin of a vehicle, specifically a truck, such as all major brands of day cab tractors. Although the foldable bed described herein is intended for such use, it is not limited to the intended use. That is, the foldable bed may be sized to fit in the cabin of any vehicle, anywhere within a passenger cabin, such as across the front row including the driver's and front passenger's seats, or across a middle row of seats, a back row of seats, or in the trunk or cargo bed of a vehicle if available. Furthermore, the bed may be removed from the vehicle altogether and used as a bed anywhere outside of the vehicle.

Figure 1:
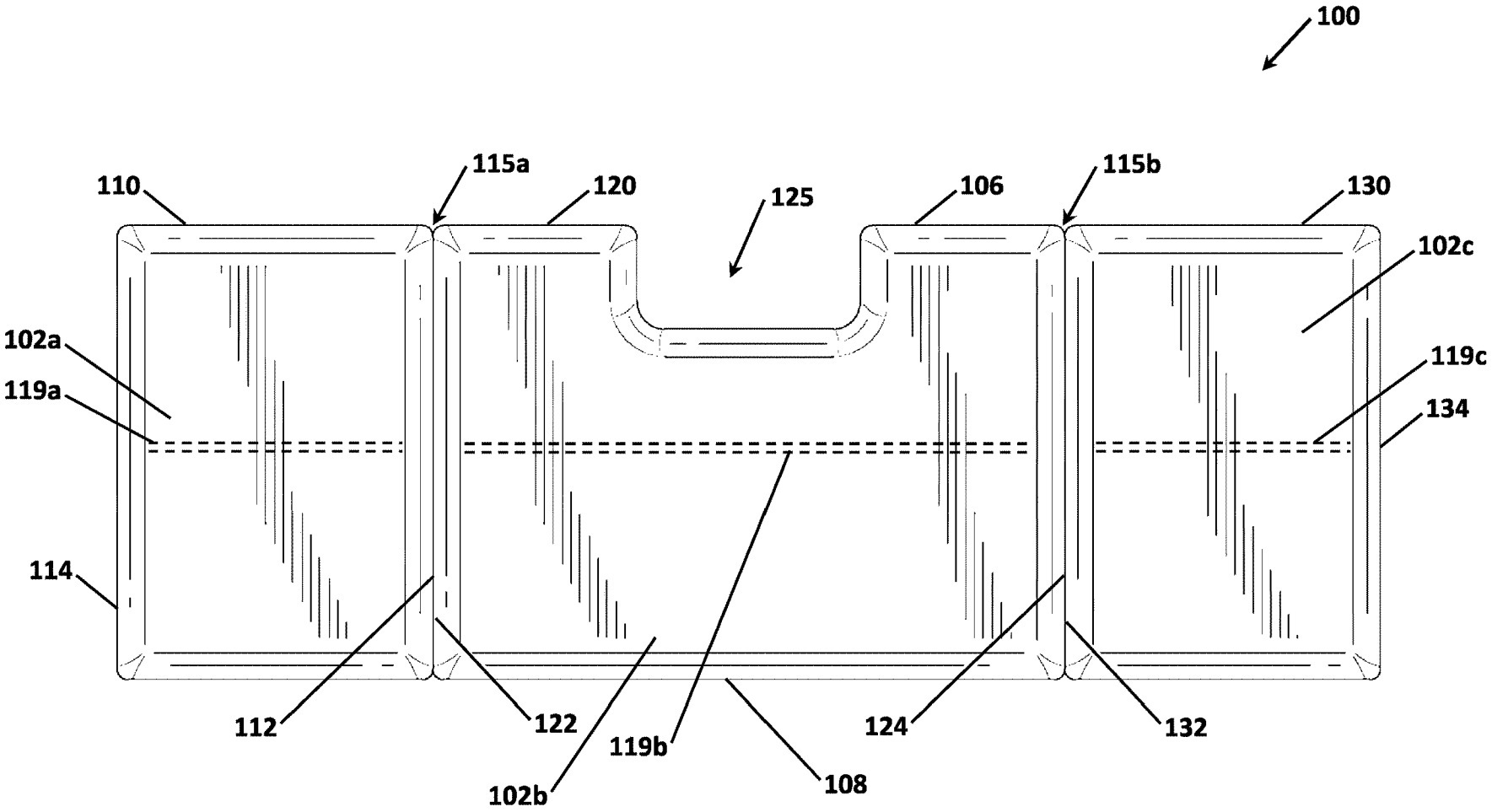
FIG. 1 is a top view of a foldable bed in an unfolded position according to an embodiment of the disclosure.
Figure 2:
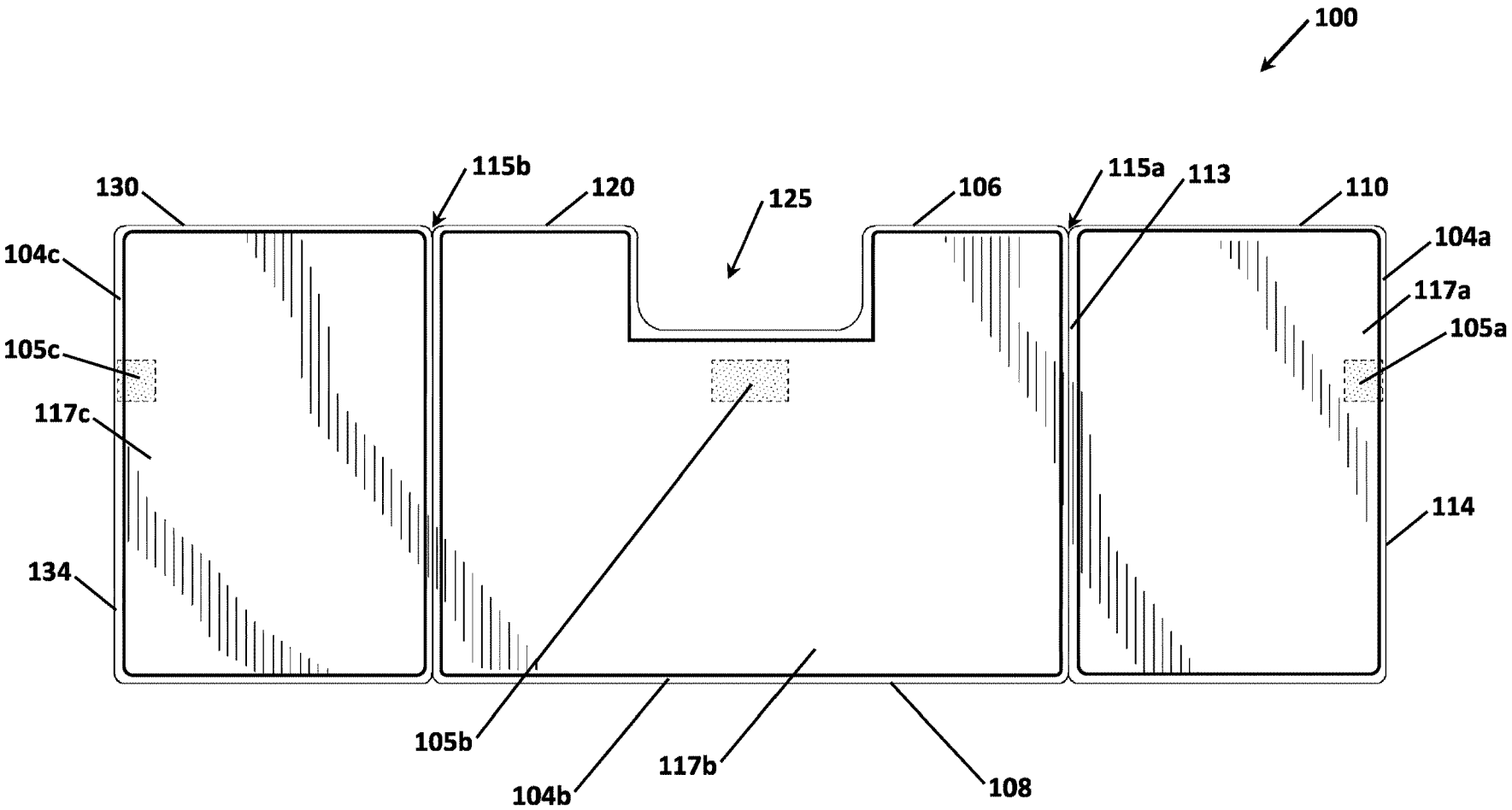
FIG. 2 is a bottom perspective view of the foldable bed of FIG. 1.

A foldable bed 100 as illustrated in FIG. 1 includes a first outer panel 110, a middle panel 120, and a second outer panel 130. Each panel 110, 120, 130 is generally rectangular in shape. The first outer panel 110 includes an inner edge 112 and an outer edge 114, and the second outer panel 130 includes an inner edge 132 and an outer edge 134. The middle panel includes a first edge 122 adjacent the inner edge 112 of the first outer panel 110, and the middle panel further includes a second edge 124 opposite the first edge 122 and adjacent the inner edge 132 of the second outer panel 130. The first outer panel 110 is hingedly coupled to the middle panel 120 such that the first outer panel 110 is able to rotate relative to the middle panel 120, i.e., the first outer panel 110 is able to rotate about an axis extending generally on or between the inner edge 112 of the first outer panel 110 and the first edge 122 of the middle panel 120. The second outer panel 130 is hingedly coupled to the middle panel 120 in the same manner that the first outer panel 110 is coupled to the middle panel 120. That is, the second outer panel 130 is hingedly coupled to the middle panel 120 such that the second outer panel 130 is able to rotate relative to the middle panel 120, i.e., the second outer panel 130 is able to rotate about an axis extending generally on or between the second edge 124 of the middle panel 120 and the inner edge 132 of the second outer panel 130. For example, as described in greater detail herein, a first hinge 115*a* can be positioned between the first outer panel 110 and the middle panel 120 and a second hinge 115*b* can be positioned between the middle panel 120 and the second outer panel 130. The foldable bed 100 has a length defined by the distance between the outer edge 114 of the first outer panel 110 and the outer edge 134 of the second outer panel 134. The foldable bed 100 further has a width defined in a direction perpendicular to the length from a first side edge 106 to a second side edge 108.

The middle panel 120 includes a cut-out 125 which is also generally rectangular in shape. The cut-out 125 is centered along the length of the middle panel 120 and offset along the width of the middle panel 120 such that the cut-out 125 is adjacent the first side edge 106 of the middle panel 120.

Figure 9:
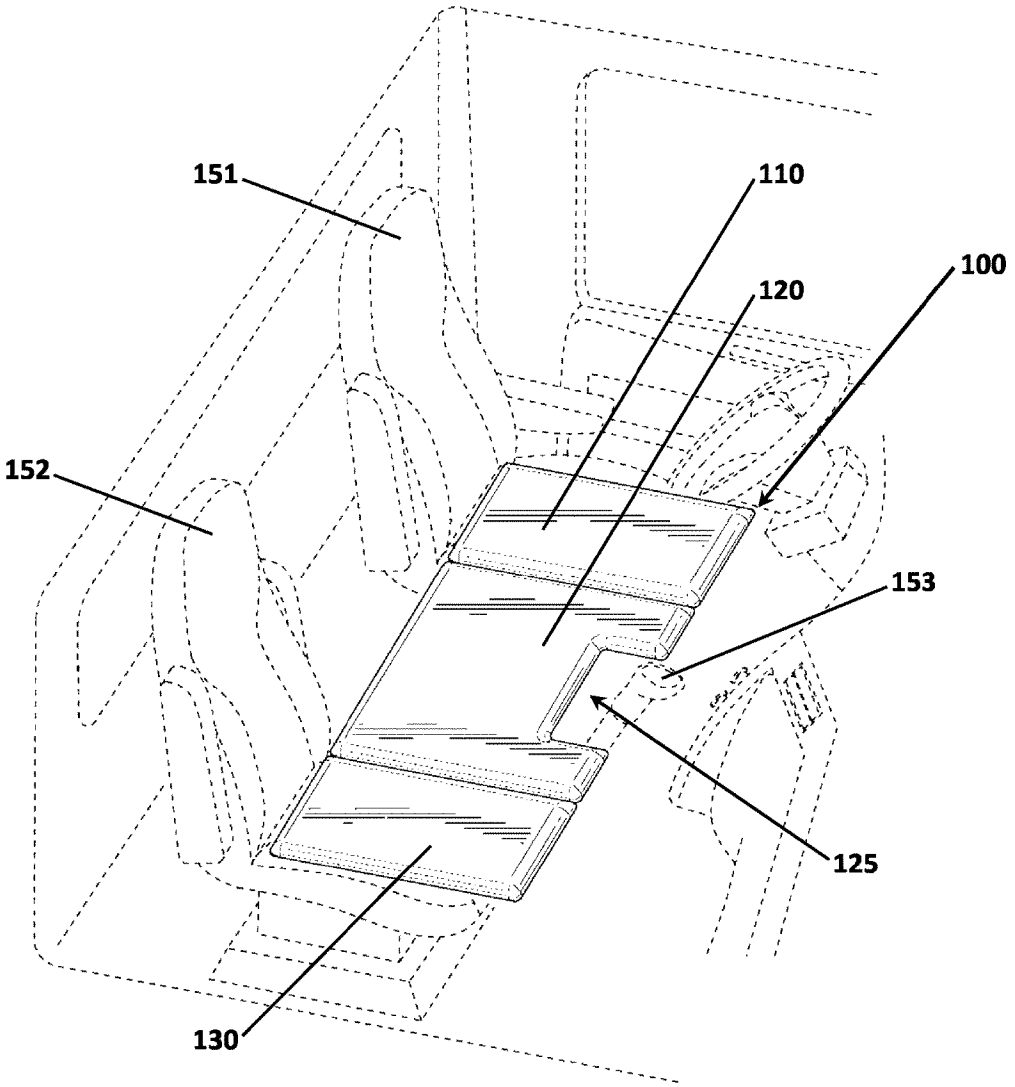
FIG. 9 is a perspective view of the foldable bed of FIG. 1 in an unfolded position disposed within a cabin of a vehicle.

The foldable bed 100 is shown in FIG. 1 in an unfolded configuration or an unfolded position. In the unfolded position, each of the panels 110, 120, 130 extends along a single plane. In other words, the middle panel 120 extends along a first plane and, when the first and second outer panels 110, 130 are in the unfolded position, the outer panels also extend along the first plane. In the unfolded position, the foldable bed 100 is configured to be positioned in the cabin of a vehicle, such as that of a cargo truck, over the driver's and passenger's seats. For example, as shown in FIG. 9, at least a portion of the first outer panel 110 may be placed on top of the driver's seat 151 and at least a portion of the second outer panel 130 may be placed on top of the passenger's seat 152 in the same row as the driver's seat 151. It is also contemplated that at least a portion of the middle panel 120 may be placed on top of the driver's seat and the passenger's seat (e.g., a portion of the middle panel 120 proximate the first outer panel 110 may be disposed on the driver's seat 151 and a portion of the middle panel 120 proximate the second outer panel 130 may be disposed on the passenger's seat 152). In some examples, at least a portion of the middle panel 120 may be suspended between the driver's seat 151 and the passenger's seat 152. In other examples, the truck may include seating or support extending across the entire row from the driver's seat 151 to the passenger's seat 152, and the foldable bed 100 may be placed thereon.

The cut-out 125 is carved out of the middle panel 120 so that the middle panel 120 is generally contoured around potentially interfering elements such as a gear shifter 153, as also shown in FIG. 9. As such, the gear shifter 153 may pass through the cut-out 125 when the foldable bed 100 is in the unfolded position placed on top of the driver's seat 151 and passenger seat 152 so that the foldable bed 100 may lay substantially flat on the seats without any protrusions or interruptions. The foldable bed 100 may lay across the width of the vehicle, approximately from the interior of a driver's side door (or proximate thereto) to the interior of a passenger's side door (or proximate thereto) when the doors of the cabin are closed. Such positioning allows a person, such as the driver, to comfortably lay across the width of the vehicle (i.e., along the length of the bed) to rest while the vehicle is parked and stationary.

Although the foldable bed 100 may have any dimensions suitable for fitting the bed within any sized vehicle, the foldable bed 100 illustrated in FIGS. 1-12 has particular dimensions for fitting within the cabin of a particularly sized truck, such as all major brands of day cab tractors. The foldable bed 100 has a length extending from the outer edge 114 of the first outer panel 110 to the outer edge 134 of the second outer panel 130 measuring between about 58 inches and about 64 inches, preferably about 61 inches. The first outer panel 110 has a length extending from outer edge 114 to inner edge 112 measuring between about 14 inches and about 15.5 inches, preferably about 14.75 inches. The middle panel 120 has a length extending from the first edge 122 of the middle panel 120 to the second edge 124 of the middle panel 120 measuring between about 30 inches and about 33 inches, preferably about 31.5 inches. The length of the middle panel 120 is preferably sufficient to span length of a gap between a driver's seat and a passenger's seat such that the middle panel 120 at least contacts both seats and a load applied to the middle panel 120 can be distributed between both seats. The second outer panel 130 has a length extending from the inner edge 132 of the second outer panel 130 to the outer edge 134 of the second outer panel 130 measuring between about 14 inches and about 15.5 inches, preferably about 14.75 inches.

The foldable bed 100 has a width extending from a first side edge 106 to a second side edge 108 measuring between about 20 inches and about 23 inches, preferably about 21.5 inches. Each of the panels 110, 120, 130 has approximately the same width. The cut-out 125 is carved out of the first side edge 106 of the middle panel 120 along approximately the center of the length of the middle panel 120 and the foldable bed 100 such that the foldable bed 100 is symmetrical about a center axis extending across the width of the bed 100. The cut-out 125 has a length measuring between about 11 inches and about 14 inches, preferably about 12.5 inches. The cut-out 125 has a width measuring between about 4 inches and about 6 inches, preferably about 5 inches. The particular dimensions of the foldable bed 100 are critical for fitting within the confines of the desired vehicle to ensure the driver is provided with effective and sufficient rest to be able to resume driving. Although not limited to the disclosed dimensions, the precise size disclosed herein optimizes the surface area of the foldable bed 100 which can be used within the vehicle to comfortably support a person's weight, while simultaneously remaining capable of being stored neatly and out of the way.

Figure 8:
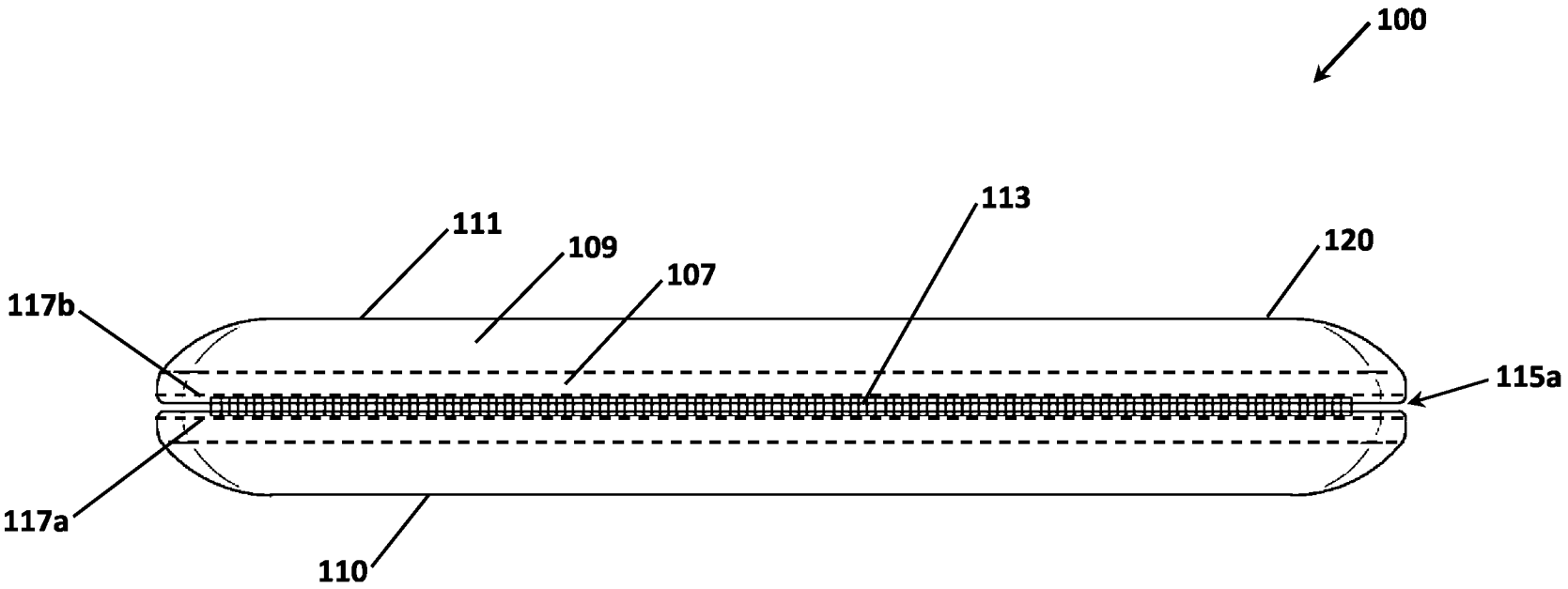
FIG. 8 is a side view of the foldable bed of FIG. 1 in the fully folded position.

As shown in FIG. 8, each panel 110, 120, 130 can be formed of a rigid block, substrate, panel or the like (hereinafter, substrate 107), such as panel of wood, plastic, or other suitable material, sized accordingly for the respective panel. As shown in FIG. 1, according to some embodiments of the present disclosure, one or more of the panels 110, 120, 130 of the present disclosure can each include a respective rigid support member 119*a-c* (together, support members 119) configured to provide enhanced structural rigidity where the panels are required to support an enhanced load (e.g., a heavier driver). The rigid support members 119 can be formed from metal (e.g., ⅛"×¼" extruded steel stock), or any other similarly rigid structural members. The substrate 107 for each panel 110, 120, 130 may include a cushion or cushioning material 109 (such as foam or other suitable material) applied to an upper surface thereof and a cover 111 (such as nylon or other suitable material) sewn, stapled, or otherwise attached about the substrate 107 and cushion 109 to hold the cushion 109 to the substrate 107. The cushion 109 may have any variation or any degree of firmness. The thickness of the cushion 109 may range between about one inch to about two inches to provide sufficient support for a person to lay comfortably on the foldable bed 100, while still maintaining the ability to fold the bed 100 and keep it space-efficient. Each of the panels 110, 120, 130 can held together by a webbing 113 spanning across the lower surfaces 104*a-c* of each of the panels 110, 120, 130 and coupled thereto (e.g., by sewing, stapling, or other suitable means). The webbing 113 can be formed of nylon, plastic or other strong and flexible material suitable for holding the panels 110, 120, 130 together and forming hinges 115*a*, 115*b* such that the first and second outer panels 110, 130 can rotate with respect to the middle panel 120 as described above. According to some embodiments of the present disclosure, piano hinges, or other suitable mechanical hinge-type devices, can be positioned between adjacent panels 110, 120, 130 affixed (e.g., by, nails, screws, staples, adhesives, or other suitable means) thereto, thereby coupling the panels 110, 120, 130 together and providing for rotational movement thereabout. According to additional embodiments of the present disclosure, one or more of the substrates 107 of the panels 110, 120, 130 can be integrally formed (e.g., through an injection molding process or the like) from a plastic, or other suitably rigid and flexible material. According to such embodiments, the hinges 115*a*, 115*b* can be living hinges formed between adjacent panels 110, 120, 130, providing for rotational movement thereabout, as described above.

The components from which the foldable bed 100 is constructed (e.g., a rigid substrate 107 with a covered cushion 109 and webbing 113 coupling each of the rigid panels 110, 120, 130 to one another) provide unique advantages to the foldable bed 100. For instance, the rigid panels 110, 120, 130 provide support to bear load while maintaining a minimal thickness of the foldable bed 100. This allows the bed 100 to be folded with the flat rigid panels 110, 120, 130 abutting each other, and the minimized thickness of the panels reduces the total thickness of the bed 100 in the folded position relative to a bed formed entirely of cushion. The cushion 109 of the present invention is sufficiently thick to optimize comfort for the user while also optimizing the thickness of the bed 100 in the folded position for storage. Further, the webbing 113 extending across the lower surface 104 of the bed 100 is a strong, lightweight material able to hold the panels together and hinge with respect to each other without interference, and with a minimal risk of malfunction.

According to some embodiments of the present disclosure, one or more secondary panels 117*a-c* (together, secondary panels 117) can be affixed to the webbing 113 on the underside of the foldable bed 100 (see FIG. 2 and FIG. 8), thereby sandwiching the webbing 113 between the substrates 107 and the secondary panels 117. The secondary panels 117, in combination with the webbing 113, function to providing additional structural rigidity to the hinges 115 of the foldable bed 100, thereby preventing the panels 110, 120, 130 of the foldable bed 100 from twisting about a longitudinal axis of the foldable bed 100 or pivoting in an unwanted direction about the hinges 115. The secondary panels 117 can be formed from a thermoplastic, or another similarly durable and resilient material, and the webbing 113 can be formed of a flexible polypropylene material, such as Propex Curv® sold and distributed by Rockywoods Fabrics LLC, or another similarly flexible and resilient material. It is contemplated that the panels 110, 120, 130 may be any shape, such as square, trapezoidal, rhombus, etc. The panels 110, 120, 130 may be shaped and sized to fit within any vehicle. It is contemplated that the cut-out 125 may be any shape (e.g., semi-circular, triangular, square, trapezoidal, etc.) and may be located anywhere along the middle panel, including along an edge or between the edges. A cut-out may also be included on either or both of the first and second outer panels 110, 130 to accommodate any other potential elements from interfering with the foldable bed 100 from lying flat across the seats.

Figure 3:
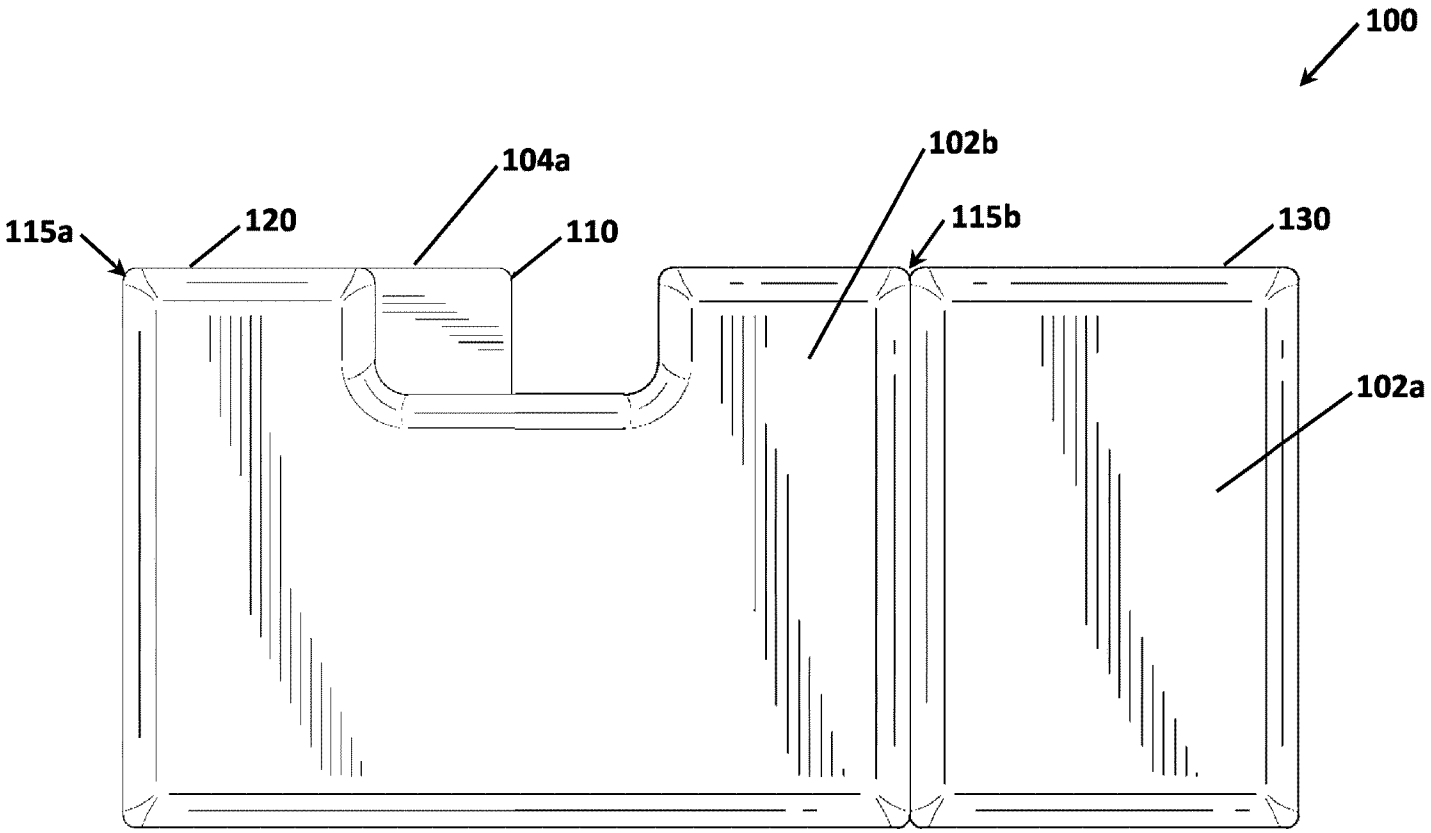
FIG. 3 is a top view of the foldable bed of FIG. 1 in a first partially folded position.
Figure 4:
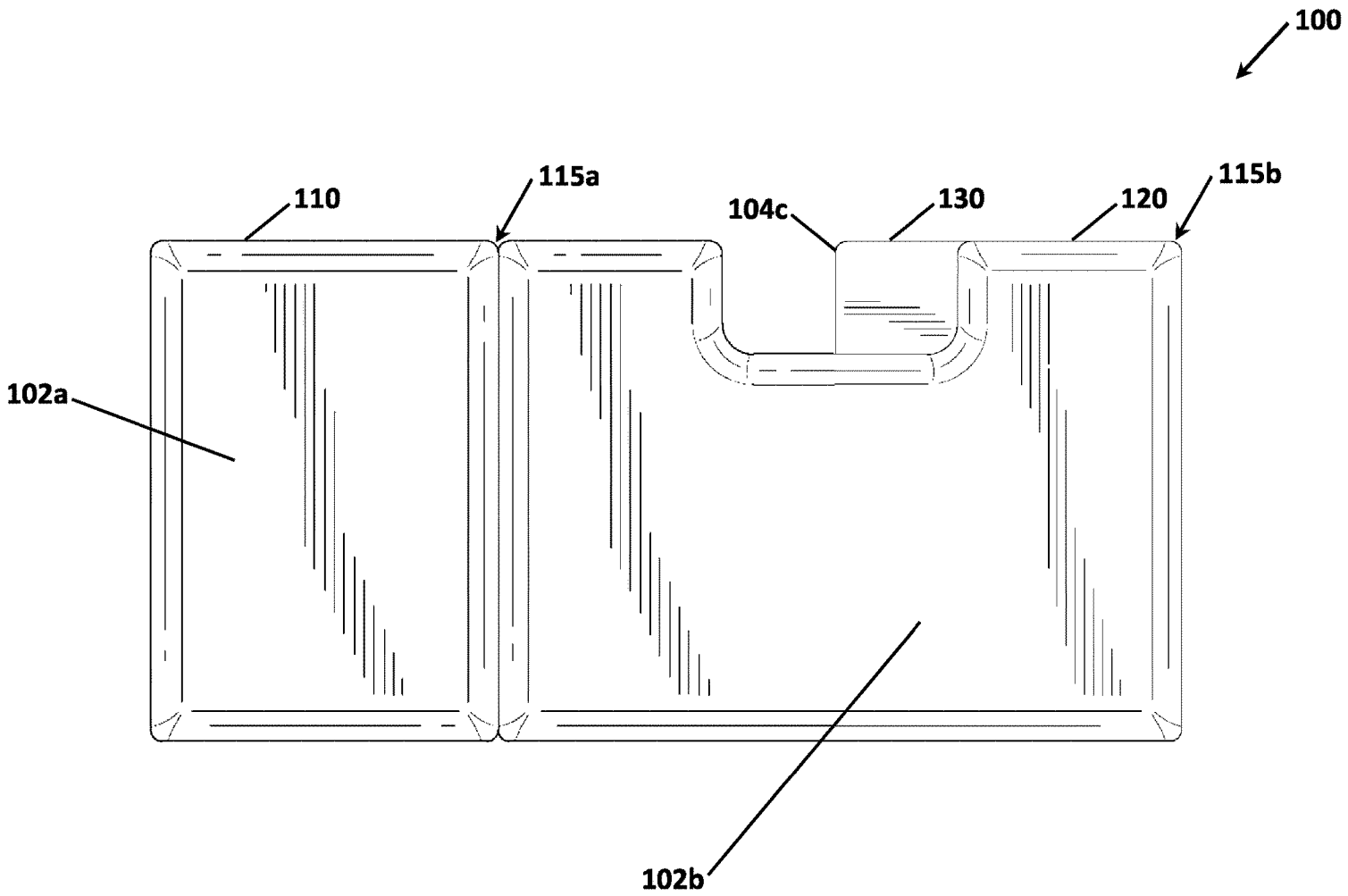
FIG. 4 is a top view of the foldable bed of FIG. 1 in a second partially folded position.

The foldable bed 100 may be transitioned from the unfolded position to a folded configuration or position. The first outer panel 110 may be rotated about its hinge axis such that a lower surface 104*a* of the first outer panel 110 is rotated toward a lower surface 104*b* of the middle panel 120 until the lower surfaces 104*a*, 104*b* abut one another, as shown in FIG. 3, which illustrates the foldable bed 100 in a partially folded position. The lower surfaces 104*a*, 104*b* of the first outer panel 110 and the middle panel 120 may each include corresponding adhesives or fixation devices 105*a*, 105*b*, such as a hook and loop material, magnets, or the like, to detachably couple the first outer panel 110 and the middle panel 120 by their respective lower surfaces 104*a*, 104*b* and hold the foldable bed 100 in the folded position. Further, the second outer panel 130 may be rotated about its hinge axis such that a lower surface 104*c* of the second outer panel 130 is rotated toward the lower surface 104*b* of the middle panel 120 until the lower surfaces 104*b*, 104*c* abut one another, as shown in FIG. 4, which illustrates the foldable bed 100 in a partially folded position. The respective lower surfaces 104*c*, 104*b* of the second outer panel 130 and the middle panel 120 may each include corresponding adhesives or fixation devices 105*c*, 105*b*, such as a hook and loop material, magnets, or the like, to detachably couple the second outer panel 130 and the middle panel 120 by their respective lower surfaces 104*c*, 104*b* and hold the foldable bed 100 in the folded position.

Figure 5:
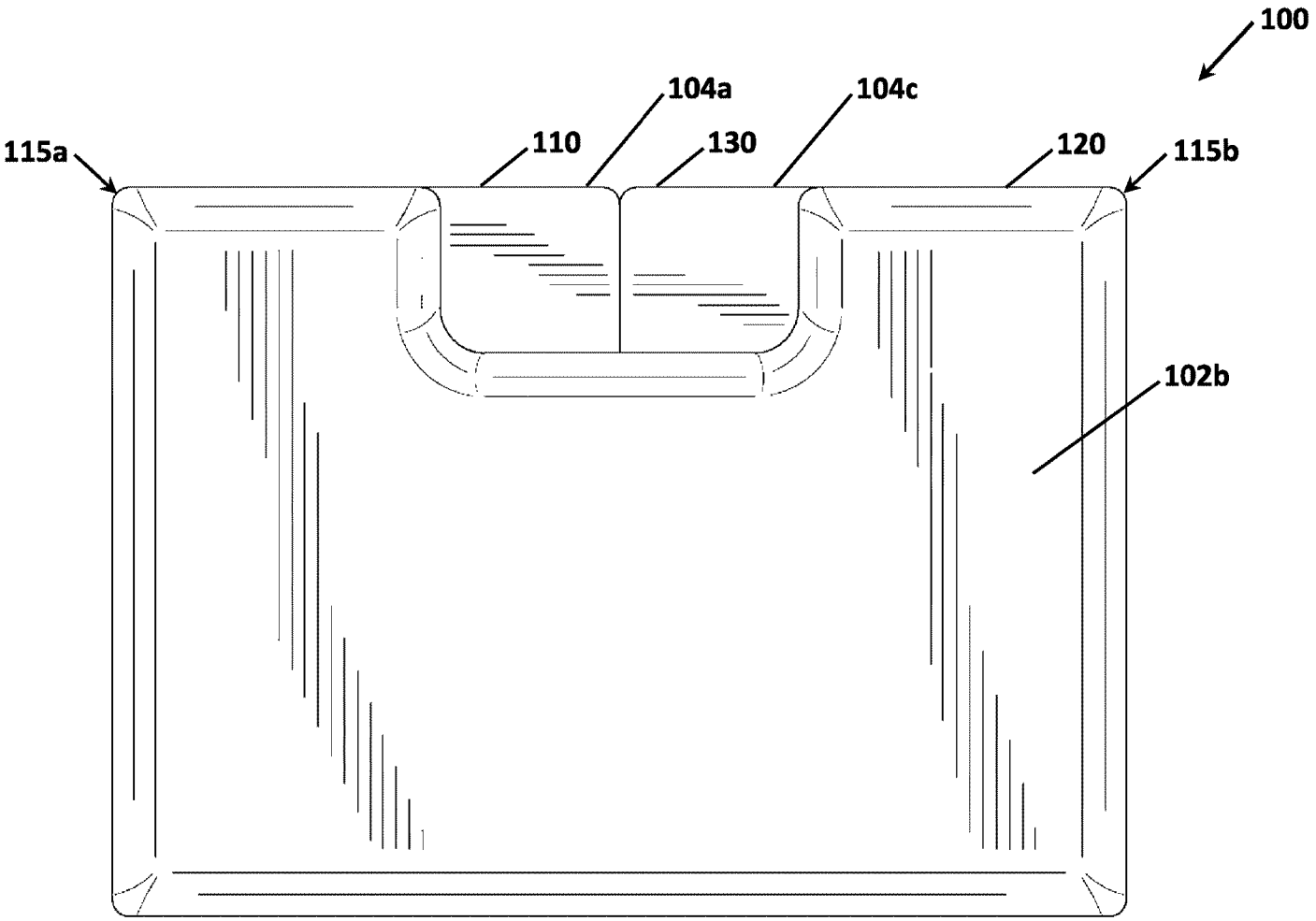
FIG. 5 is a top view of the foldable bed of FIG. 1 in a fully folded position.
Figure 6:
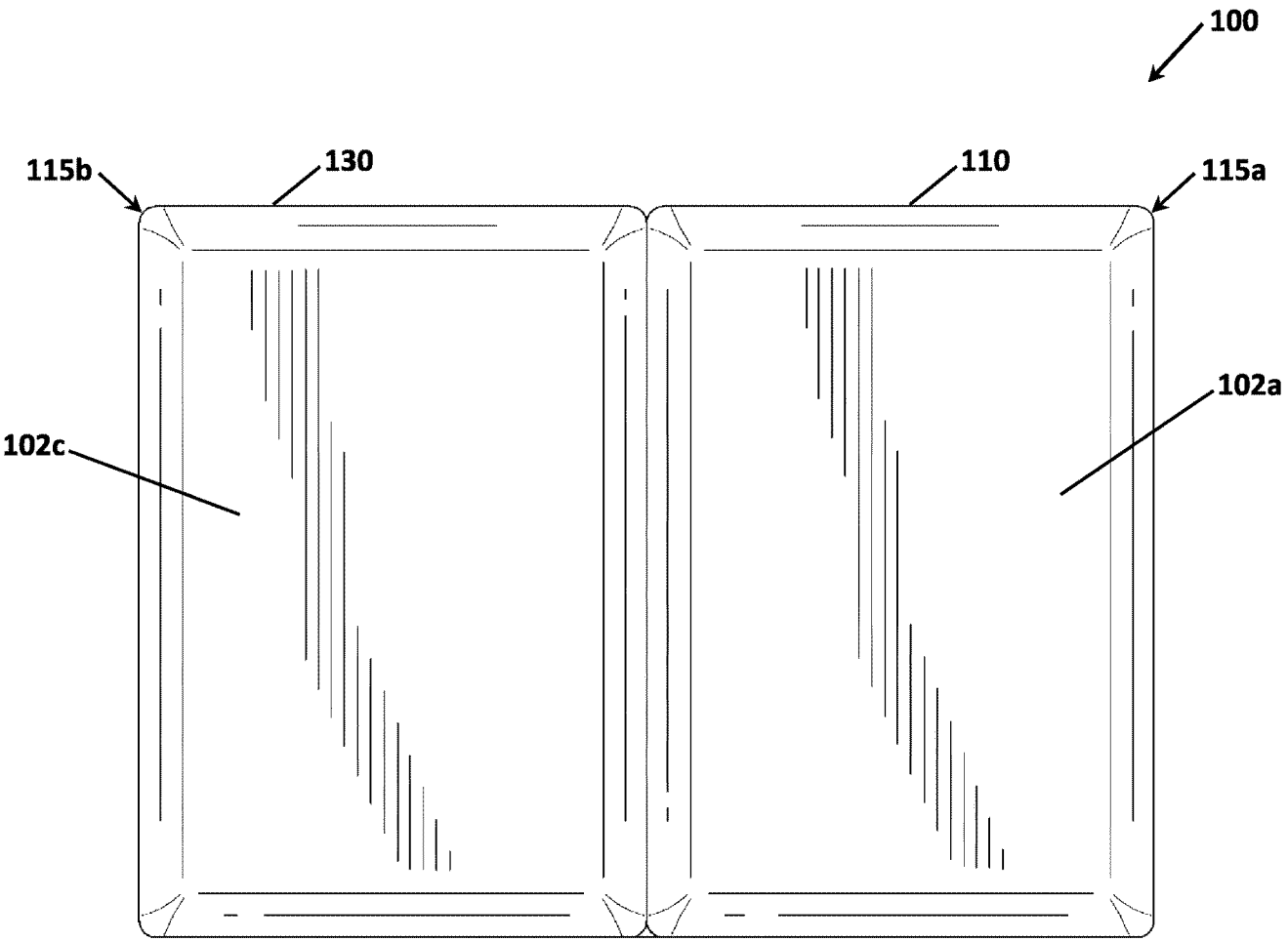
FIG. 6 is a bottom view of the foldable bed of FIG. 1 in the fully folded position.
Figure 7:
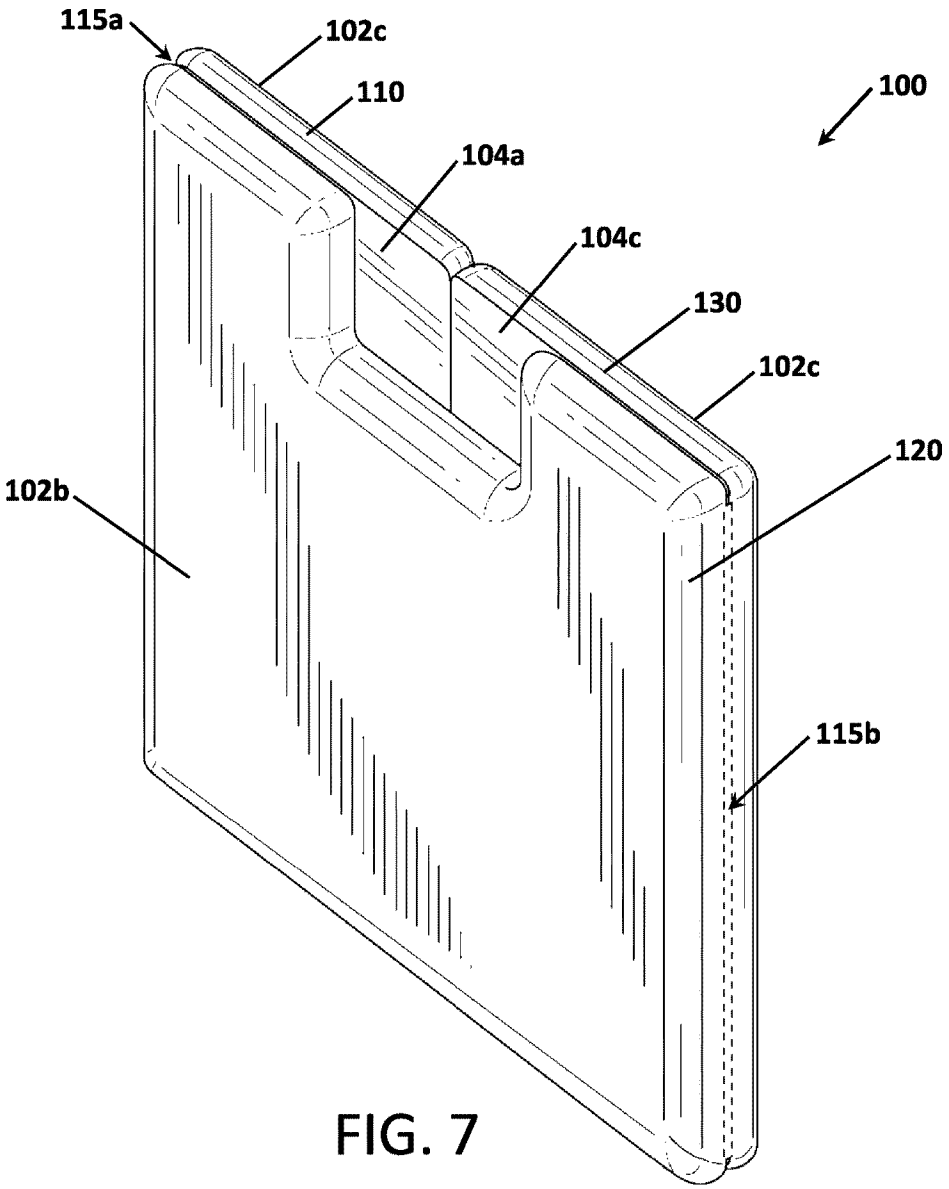
FIG. 7 is a perspective view of the foldable bed of FIG. 1 in the fully folded position.

The foldable bed 100 is in the folded position when the lower surfaces 104*a*, 104*c* of both the first and second outer panels 110, 130 abut the lower surface 104*b* of the middle panel 120, as shown in FIGS. 5-6. In the folded position, the first and second outer panels 110, 130 no longer extend along the first plane (i.e., the plane along which the middle panel extends), but instead the outer panels 110, 130 extend along a same second plane which is parallel to the first plane. In the folded position, the length of the foldable bed 100 is reduced so that the bed 100 is more compact and takes up less space in the longitudinal direction. The folded position optimizes the size of the foldable bed 100 so that it can be placed and stored in a convenient location without being a nuisance or interference while the bed 100 is not in use. For example, a driver can fit the foldable bed 100 in the folded position behind the passenger's seat or behind the driver's seat within the cabin. The ability to store the foldable bed 100 in a convenient location such as behind one or both of the seats allows for easy access to the bed 100 to deploy onto the seats or stow the bed away without hassle. It is also contemplated that the first and second outer panels 110, 130 may be configured to rotate in the opposite direction such that upper surfaces 102*a*, 102*c* of the first and second outer panels 110, 130 abut an upper surface 102*b* of the middle panel 120 in the folded position. However, in some examples, as in the example described above, the nylon webbing 113, or other hinge mechanism (e.g., hinges 115*a*, 115*b*), holding the panels 110, 120, 130 together may only allow the first and second outer panels 110, 130 to rotate in the direction in which their lower surfaces 104 face, and may prevent the panels from rotating in the opposite direction beyond the flattened (unfolded) configuration of the foldable bed 100 in which each of the panels 110, 120, 130 lies in the same first plane.

Figure 10:
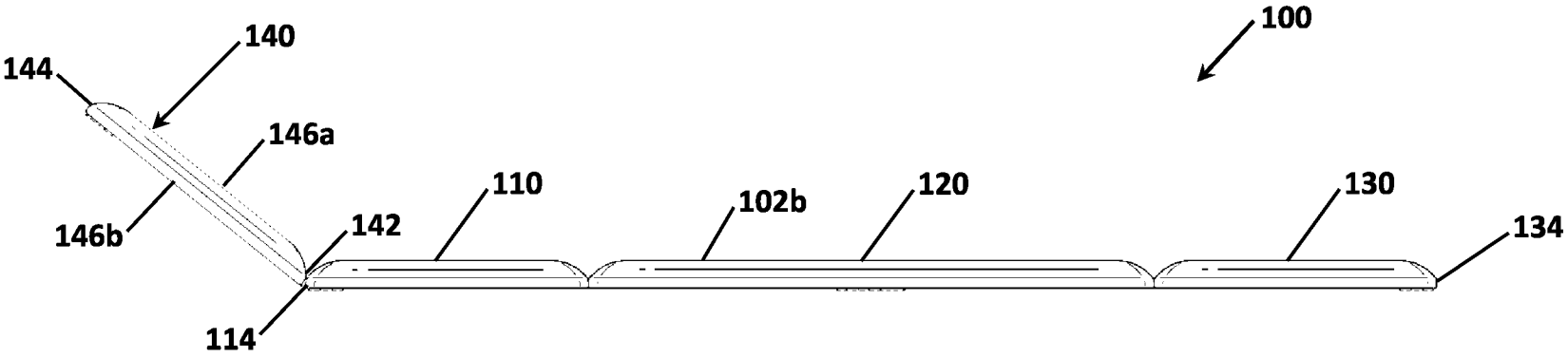
FIG. 10 is a front view of a foldable bed with an upper panel according to an embodiment of the disclosure.
Figure 11:
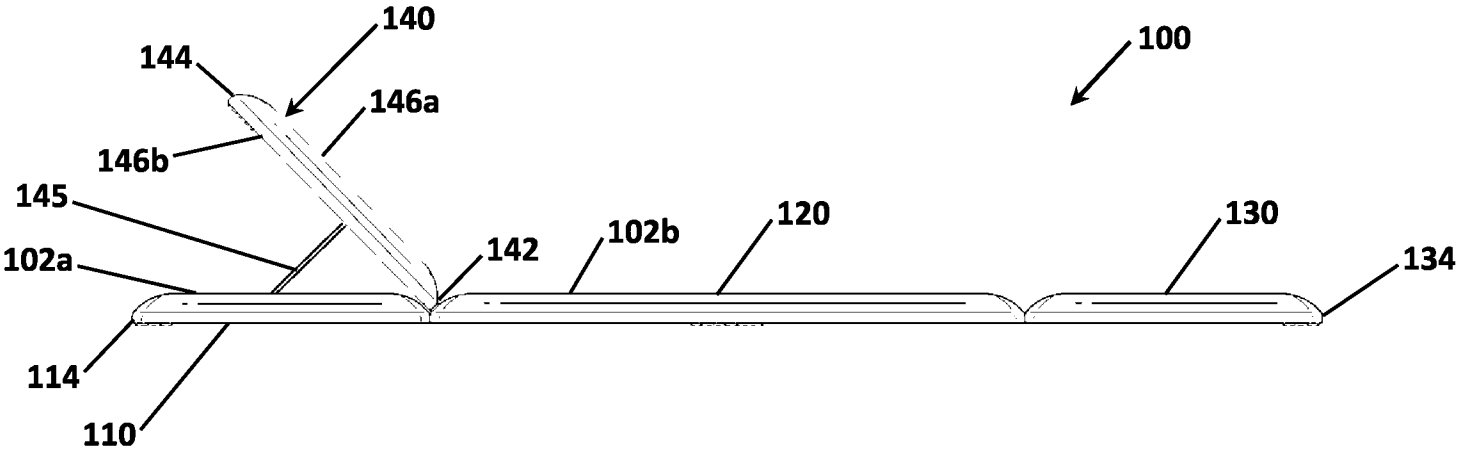
FIG. 11 is a front view of a foldable bed with an upper panel having a support rod according to an embodiment of the disclosure.

As shown in FIGS. 10 and 11, the foldable bed 100 may optionally include an upper panel 140 extending from an inner edge 142 to an outer edge 144. The upper panel 140 may be formed in substantially the same manner as the other panels 110, 120, 130, e.g., including a rigid block, substrate, panel or the like, such as wood or plastic, with a cushioning applied thereon, such as foam, and a cover sewn or otherwise attached to the rigid panel over the cushion to maintain the placement of the cushion (see, e.g., FIG. 8). The upper panel 140 has a length extending between the inner edge 142 and the outer edge 144 measuring between about 18 inches and about 21 inches, preferably about 19.5 inches. The upper panel 140 may be coupled to the foldable bed 100 along the inner edge 142 of the upper panel 140, and the inner edge 142 may be coupled anywhere along the bed, e.g., the first outer panel 110. The upper panel 140 is shown in an upright position in FIG. 10. In the upright position, the upper panel 140 extends along a third plane, the third plane being oblique to and intersecting the first plane along which the panels 110, 120, 130 extend in the unfolded position. In some examples, such as the example shown in FIG. 10, the upper panel 140 may be detachably coupled to the first outer panel 110 at the inner edge 142 of the upper panel 140 and the outer edge 114 of the first outer panel 110. The upper panel 140 may be attached to the first outer panel 110 by an adhesive or fixation device of any kind, such as a hook and loop material, and the upper panel 140 may then be placed in an upright position as shown in FIG. 10 to lean against the interior of the driver's side door when the door is closed.

The upper panel 140 may alternatively be coupled to the outer edge 134 of the second outer panel 130 and lean against the interior of the passenger's side door when the door is closed. One or more of the upper panel 140 may be included in a kit or as an additional attachment piece either together with or separate from the foldable bed 100, and the upper panel 140 may extend from the foldable bed forming an angle anywhere between 0 and 90 degrees relative to the first plane along which the panels of the bed extend in the unfolded position. The upright positioning can improve comfort for a user and thereby improve quality of rest by providing an inclined surface for a person to lay at a more natural angle rather than completely flat across a single plane, with the interior of the door bearing the weight of the person laying on the foldable bed 100. It is also contemplated that the upper panel 100 may have any degree of curvature to further improve the positioning angle or cater to a user's preferred sleeping position.

In other examples, the upper panel 140 may be detachably coupled to any one of the panels 110, 120, 130 or a portion therebetween. For example, as shown in FIG. 11, the inner edge 142 of the upper panel 140 may be detachably coupled at the hinge or axis (e.g., at edge 112) between the first outer panel 110 and the middle panel 120. The inner edge 142 of the upper panel 140 may include an adhesive or fixation device applied thereon, such as a hook and loop material, that can be used to place the upper panel 140 in a desired position to detachably fix the inner edge 142 of the upper panel 140 relative to the foldable bed 100. The upper panel 140 may then be held in the upright position by a support rod 145 as described below in greater detail. When use of the foldable bed 100 with the upright panel 140 attachment is finished, the upper panel 140 may be decoupled from the foldable bed 100 and stored away in a location such as those described above, wherein in the detached upper panel 140 may be placed adjacent the foldable bed 100 in the folded position such that the upper panel 140 lies in a plane extending parallel to the planes of the panels of the foldable bed 100. Alternatively, because the upper panel 140 is detachable, it may be stored completely separately from the foldable bed 100 to improve space efficiency of the vehicle in which the foldable bed 100 is used in.

In some examples, the upper panel 140 may be hingedly coupled to any one of the first outer panel 110, the middle panel 120, or the second outer panel 130 or anywhere therebetween. For example, the inner edge 142 of the upper panel 140 may be hingedly coupled at the hinge or axis between the first outer panel 110 and the middle panel 120. In such examples, the upper panel 140 may be fixed to the other panels and adapted to fold with the bed as the foldable bed 100 transitions to the folded position. That is, when the first outer panel 110 is in the folded position as described above with the lower surface 104 of the first outer panel 110 abutting the lower surface 104 of the middle panel 120, the upper panel 140 may also rotate about its hinge and fold in a first direction such that the lower surface 148 of the upper panel 140 follows the first outer panel 110, and the lower surface 148 of the upper panel 140 abuts the upper surface 102 of the first outer panel 110 in the folded position. Alternatively, the upper panel 140 may rotate about its hinge in a second direction opposite the first direction, such that an upper surface 146*a* of the upper panel 140 is rotated toward the upper surface 102*b* of the middle panel 120 and the surfaces abut one another in the folded position. In either manner of folding described above, the length of the foldable bed 100 is reduced so that the bed is more compact and takes up less space in the longitudinal direction. The folded position optimizes the size of the foldable bed 100 so that it can be placed and stored in a convenient location without being a nuisance or interference while the bed is not in use. For example, a driver can fit the foldable bed 100 in the folded position behind the passenger's seat or behind the driver's seat within the cabin. The ability to store the foldable bed 100 in a convenient location such as behind one or both of the seats allows for easy access to the bed to deploy or stow the bed away without hassle.

In some examples, the upper panel 140 may include a means for remaining in the upright position, particularly when a load is applied to the upper panel 140, such as the weight of at least a portion of a person's body, and in examples in which the upper panel 140 is not positioned to lean against the interior of the door of the vehicle. For example, the foldable bed 100 may include at least one support rod 145 extending between a lower surface 146*b* of the upper panel 140 and the upper surface 102*a* of the first outer panel 110, as shown in FIG. 11. In some examples, the foldable bed 100 may include a single support rod 145 positioned to extend from the first outer panel 110 generally in the middle along the length and width of the first outer panel 110. Alternatively, the foldable bed 100 may include a plurality of support rods 145 extending from one of the side edges 106, 108 of the first outer panel 110 or the outer edge 114 of the first outer panel 110 up to a surface or edge of the upper panel 140. The support rod 145 may extend perpendicular to the first plane (i.e., the plane along which the first outer panel 110 extends) or oblique to the first plane, e.g., perpendicular to the third plane (i.e., the plane along which the upper panel 140 extends).

At least one support rod 145 may be detachably coupleable to the upper panel 140 to hold the panel in the upright position. Alternatively, at least one support rod 145 may be hingedly coupled to the lower surface 146*b* of the upper panel 140 such that the support rod 145 can be adjusted to transition from a protruding position to a folded position. That is, in the folded position, the support rod 145 may have a length which extends generally parallel to plane along which the upper panel 140 extends, and the support rod 145 may abut the lower surface 146 of the upper panel 140, with a first end of the support rod 145 hingedly coupled to an edge or the lower surface 146*b* of the upper panel 140. Any portion of the support rod 145, such as a second end opposite a first end, may be pulled to separate the support rod 145 from the lower surface 146 of the upper panel 140 such that the support rod 145 rotates about its hinge. The support rod 145 may rotate anywhere between 0 and 180 degrees, e.g., approximately 90 degrees so that its length extends along an axis oblique to the plane along which the upper panel 140 extends, and thus the second end of the support rod 145 is able to contact a structure below, such as the first outer panel 110, to hold the upper panel 140 in the upright position. When it is then desired to transition the upper panel 140 from the upright position to the folded position (or remove the upper panel 140 altogether), the upper panel 140 may simply be lifted to remove the load applied to the support rod 145, and the support rod 145 may thereafter be folded in the opposite direction it was unfolded to revert the support rod to its folded position flush against the lower surface 146*b* of the upper panel 140.

Figure 12:
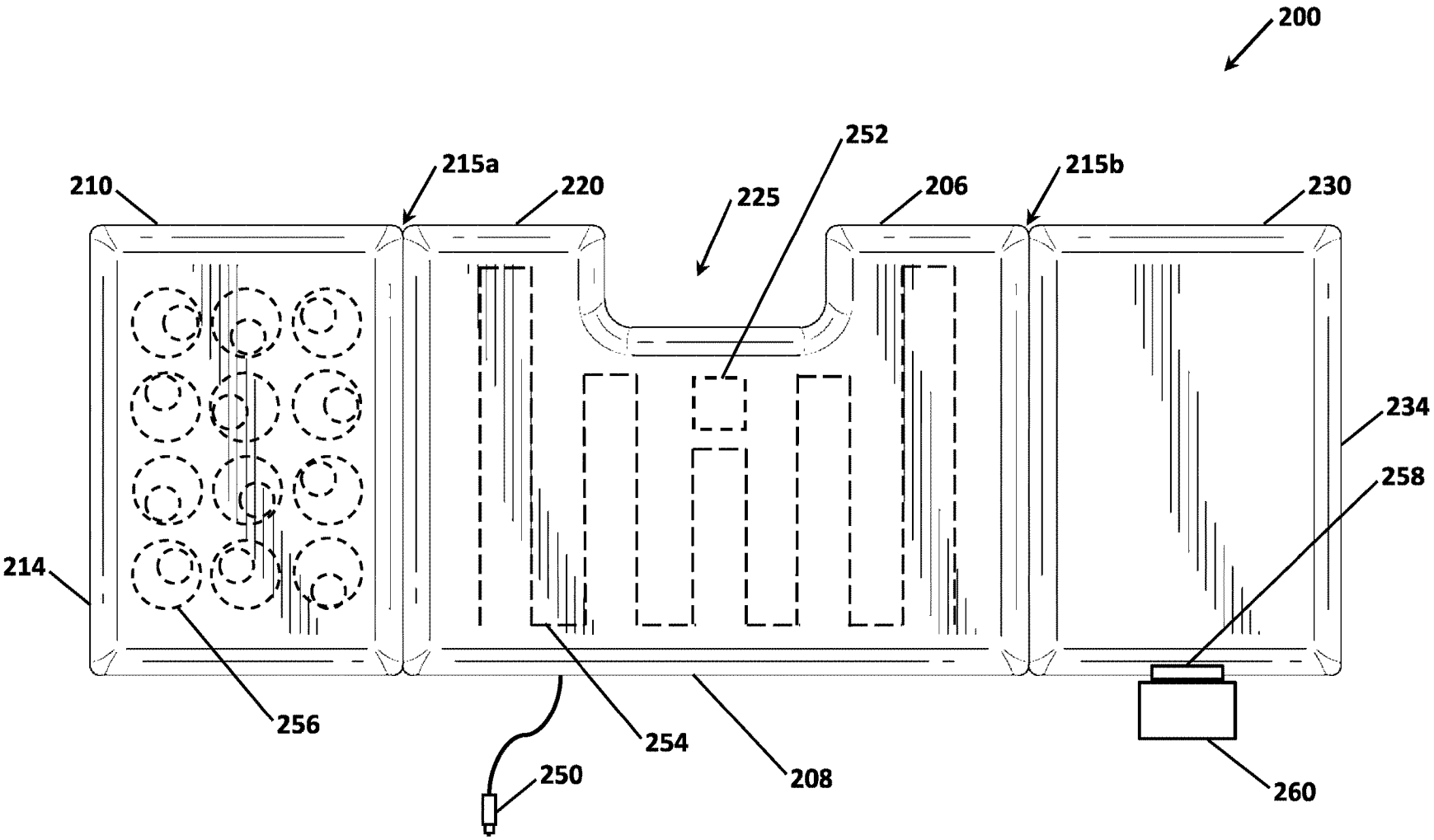
FIG. 12 is a top view of another foldable bed according to an embodiment of the present disclosure.

FIG. 12 is a top view of another foldable bed according to present disclosure (hereinafter, foldable bed 200). Foldable bed 200 can be substantially similar in both form and function to foldable bed 100, discussed in connection with FIGS. 1-11, except for distinctions noted herein. Accordingly, foldable bed 200 can include a first outer panel 210 coupled to a middle panel 220 by way of a hinge 215*a* and a second outer panel 230 coupled to the middle panel 220 by way of a hinge 215*b*. An exterior periphery of the foldable bed 200 is defined by a right edge 214, a left edge 234, a front edge 206, a rear edge 208, and a cut-out 225 disposed on the front edge 206 of the middle panel 220. The foldable bed 200 can also include a power supply 250 (e.g., a 12V DC male power connector for receiving electrical power from a 12V DC female power socket of a vehicle and/or a battery, such as a rechargeable battery pack) for providing electrical power to one or more electrical components of the foldable bed 200.

According to one example, the power supply 250 can provide power to one or more sensors 252 disposed within one or more of the panels 210, 220, 230 for determining when the foldable bed 200 is bearing weight (e.g., determining when a user is resting on the foldable bed 200). As will be understood by those of ordinary skill in the art, the sensor 252 can be a weight sensor, pressure sensor, proximity sensor, switch, or any other means configured to determine when a user is resting on the foldable bed 200. The sensor 252 can also include a communications interface (e.g., serial interface, Bluetooth, Wi-Fi, cellular, etc.) for transmitting sensor data to another device, such as, but not limited to, a memory disposed within the foldable bed 200, a driver's mobile device, an electronic log device (ELD) associated with the driver and/or vehicle, a computer system or server of a trucking company, a computer system or server controlled by the Federal Motor Carrier Safety Administration (FMSCA) of the United States Department of Transportation (USDOT), or any other computing device.

Accordingly, the sensor 252 can record data that can be stored and later analyzed to determine periods of time when the driver of the vehicle is resting on the foldable bed 200. Furthermore, this sensor data can be accessed by the FMSCA during an audit to determine if a driver and/or trucking company is complying with federally mandated guidelines related to maximum driving times. Further still, by using the sensor 252 to record periods of rest, drivers can "split their time" between periods of rest to increase the maximum amount of driving time in a given week by up to twenty-one (21) hours.

According to another example, the power supply 250 can provide power to a heating element 254, which can be disposed within one or more of the panels 210, 220, 230 and can be adjustably activated to heat the foldable bed 200 when desired. Similarly, the power supply 250 can provide power to one or more massaging elements or features 256, which can be disposed within one or more of the panels 210, 220, 230 and can be adjustably activated to provide a massaging action when desired. The electrical components of the foldable bed 200 can also include, but are not limited to, one or more of a cigarette lighter, a heated or cooled cup holder, a reading light and one or more USB ports, a wireless charging pad, an AC power inverter, or other means for providing power to another electronic device (e.g., mobile device, laptop, gaming device, or the like). The foldable bed 200 can also include one or more of a keychain holder and a storage bag, tray, caddy, or lockbox configured to hold and/or organize one or more of a driver's wallet, sunglasses, pens, and other personal items.

According to some embodiments of the present disclosure, the foldable bed 200 can include a modular connection interface 258 for coupling one or more modular attachments 260 to the foldable bed 200. The modular connection interface 258 can be disposed about the periphery of the foldable bed 200, defined by the right edge 214, the left edge 234, the front edge 206, the rear edge 208, and the cut-out 225, and includes a coupling mechanism for attaching one or more of the modular attachments 260 to the foldable bed 200, for example, by way of a reciprocal coupling mechanisms disposed on the modular attachments 260. The modular connection interface 258 can also include an electrical communication interface coupled to the power supply 250 and configured to provide power to one or more of the modular attachments 260, for example, by way of reciprocal electrical communication interfaces of the modular attachments 260. Accordingly, the modular attachments 260 can be mechanically and electrically coupled to the foldable bed 200 and can include one or more of the cigarette lighter, the heated or cooled cup holder, the reading light, the USB ports, the wireless charging pad, the AC power inverter, the keychain holder, and the storage bag, tray, caddy, or lockbox described above.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A foldable bed comprising:

a first outer panel defining a length and a width;

a middle panel hingedly coupled to the first outer panel along a first inner edge of the first outer panel, the middle panel defining a length and a width, the middle panel defining a cut-out having a length and a width;

a second outer panel hingedly coupled to the middle panel opposite the first outer panel and along a second inner edge of the second outer panel, the second outer panel defining a length and a width;

an upper panel extending from the first inner edge or the second inner edge;

wherein each of the first outer panel, the middle panel, the upper panel, and the second outer panel includes a rigid block with a cushion coupled thereto; and wherein each of the first outer panel, the middle panel, and the second outer panel are hingedly coupled by a webbing extending across a lower surface of the foldable bed.

2. The foldable bed of claim 1, wherein the middle panel is sized and shaped to contact and rest on a driver's seat and a front passenger's seat of a vehicle and span a gap between the driver's seat and the front passenger's seat.

3. The foldable bed of claim 1, wherein a length of the bed is defined by the sum of the length of the first outer panel, the length of the middle panel, and the length of the second outer panel, the length of the bed measuring between about 58 inches and about 64 inches.

4. The foldable bed of claim 1, wherein the length of the cut-out measures between about 11 inches and about 14 inches.

5. The foldable bed of claim 1, wherein the first outer panel is configured to fold relative to the middle panel about a hinge located between the first inner edge of the first outer panel and a first edge of the middle panel to transition from a flat position to a folded position, and wherein the first outer panel includes a first fixation device on a lower surface of the first outer panel configured to contact a reciprocal second fixation device on a lower surface of the middle panel to hold the first outer panel in the folded position.

6. The foldable bed of claim 5, wherein the second outer panel is configured to fold relative to the middle panel about a hinge located between the second inner edge of the second outer panel and the second edge of the middle panel to transition from the flat position to a folded position, and wherein the second outer panel includes a third fixation device on a lower surface of the second outer panel configured to contact the second reciprocal fixation device on the lower surface of the middle panel to hold the second outer panel in the folded position.

7. The foldable bed of claim 6, wherein the middle panel extends along a first plane, and when the first outer panel and the second outer panel are in the folded position, the first and second outer panels extend along a second plane parallel to the first plane.

8. The foldable bed of claim 1, wherein:

the the upper panel is removably coupled to the first outer panel along the first inner edge, wherein the first outer panel extends along a first plane, and the upper panel extends along a second plane oblique to the first plane.

9. The foldable bed of claim 8, further comprising one or more support rods disposed between the upper panel and the first outer panel to hold the upper panel in the second plane.

10. The foldable bed of claim 8, wherein the upper panel is configured to transition from an upright position to a flat position, wherein in the flat position, the upper panel extends along a third plane parallel to the first plane.

11. The foldable bed of claim 8, wherein at least a portion of the upper panel defines a curvature.

12. A foldable bed comprising:

a first outer panel defining a length and a width;

a middle panel hingedly coupled to the first outer panel along a first inner edge of the first outer panel defining a first living hinge between the first outer panel and the middle panel, the middle panel defining a length and a width, the middle panel defining a cut-out having a length and a width;

a second outer panel hingedly coupled to the middle panel opposite the first outer panel and along a second inner edge of the second outer panel defining a second living hinge between the second outer panel and the middle panel, the second outer panel defining a length and a width;

an upper panel extending from the first living hinge or the second living hinge;

wherein each of the first outer panel, the middle panel, the upper panel, and the second outer panel includes a rigid substrate and a cushion coupled to the rigid substrate; and wherein the rigid substrates of the first outer panel, the middle panel, and the second outer panel are integrally formed, the rigid substrates of the first outer panel and the middle panel being hingedly coupled by way of the first living hinge along the first inner edge, the rigid substrates of the middle panel and the second outer panel being hingedly coupled by way of the second living hinge along the second inner edge.

13. The foldable bed of claim 12, wherein the first outer panel is configured to fold relative to the middle panel about the first living hinge, located between the first inner edge of the first outer panel and a first edge of the middle panel, to transition from a flat position to a folded position, and wherein the first outer panel includes a first fixation device on a lower surface of the first outer panel configured to contact a reciprocal second fixation device on a lower surface of the middle panel to hold the first outer panel in the folded position.

14. The foldable bed of claim 13, wherein the second outer panel is configured to fold relative to the middle panel about the second living hinge, located between the inner edge of the second outer panel and the second edge of the middle panel, to transition from the flat position to the folded position, and wherein the second outer panel includes the third fixation device on a lower surface of the second outer panel configured to contact the second reciprocal fixation device on the lower surface of the middle panel to hold the second outer panel in the folded position.

15. The foldable bed of claim 14, wherein the first living hinge is configured such that the first outer panel is prevented from rotating about the first living hinge beyond a position where the first outer panel and the middle panel are in an extended coplanar configuration.

16. The foldable bed of claim 15, wherein the second living hinge is configured such that the second outer panel is prevented from rotating about the second living hinge beyond a position where the second outer panel and the middle panel are in an extended coplanar configuration.

17. The foldable bed of claim 12, wherein a the upper panel is removably coupled to the first outer panel along the first living hinge or the second living hinge, wherein the first outer panel extends along a first plane, and the upper panel extends along a second plane oblique to the first plane.

18. The foldable bed of claim 12, further comprising one or more support rods disposed between the upper panel and the first outer panel to hold the upper panel in the second plane.

19. The foldable bed of claim 17, wherein the upper panel is positionable in an upright position where the upper panel extends along the second plane oblique to the first plane and a flat position where the upper panel extends along a third plane parallel to the first plane.

20. A kit comprising:

a foldable bed comprising:

a first outer panel extending along a first plane;

a middle panel hingedly coupled to the first outer panel along a first inner edge of the first outer panel, the middle panel defining a cut-out;

a second outer panel hingedly coupled to the middle panel opposite the first outer panel and along a second inner edge of the second outer panel; and an upper panel attachment configured to be detachably coupled to the foldable bed along the first inner edge or the second inner edge such that the upper panel attachment is positionable in an upright position where the upper panel attachment extends along a second plane oblique to the first plane and a flat position where the upper panel attachment extends along a third plane parallel to the first plane.

* * * * *